US010842274B1

(12) United States Patent
Crawford et al.

(10) Patent No.: US 10,842,274 B1
(45) Date of Patent: Nov. 24, 2020

(54) ZERO-WALL CLEARANCE LINKAGE MECHANISM WITH POWER SEAT DRIVE

(71) Applicant: L&P PROPERTY MANAGEMENT COMPANY, South Gate, CA (US)

(72) Inventors: Cheston Brett Crawford, Randolph, MS (US); Michael Andrew Crum, Mantachie, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 16/417,165

(22) Filed: May 20, 2019

(51) Int. Cl.
*A47C 1/034* (2006.01)
*A47C 7/00* (2006.01)
*A47C 1/032* (2006.01)

(52) U.S. Cl.
CPC ..... *A47C 1/0345* (2013.01); *A47C 1/03211* (2013.01)

(58) Field of Classification Search
CPC . A47C 1/03211; A47C 1/0355; A47C 1/0242; A47C 1/0345; A47C 1/0342; A47C 1/02
See application file for complete search history.

(56) References Cited

U.S. PATENT DOCUMENTS 5,013,084 A * 5/1991 May ..... A47C 1/0355 297/85 R
8,016,348 B2 * 9/2011 Hoffman ..... A47C 3/0255 297/85 M
8,696,054 B2 * 4/2014 Crum ..... A47C 1/0352 297/85 M
10,575,644 B2 * 3/2020 Bryant ..... A47C 1/0355
2008/0150329 A1 * 6/2008 Lawson ..... A47C 1/0355 297/84
2008/0290710 A1 11/2008 Lawson
2009/0174251 A1 * 7/2009 Lawson ..... A47C 1/0352 297/85 R
2010/0072805 A1 * 3/2010 Qiu ..... A47C 1/0355 297/85 R (Continued)

OTHER PUBLICATIONS

International Search Report and Written Opinion received for PCT Application No. PCT/US2019/062246, dated Jan. 17, 2020, 9 pages.

(Continued)

*Primary Examiner* — Shin H Kim
(74) *Attorney, Agent, or Firm* — Shook, Hardy & Bacon L.L.P.

(57) ABSTRACT

A metal-to-the-floor linkage mechanism provides backrest recline and ottoman extension for a seating unit. The linkage mechanism has a base and a pair of seat mounting plates that are used to attach a seat to the mechanism. The linkage mechanism comprises a first and a second plurality of links that are each pivotally coupled between the base and a corresponding one of the pair of seat mounting plates. The first and second plurality of links moveably interconnect the base and the seat mounting plates to control movement of the seating unit between closed, TV, reclined and fully-reclined positions. In the fully-reclined position, the seat mounting plates are moved to a position by the first plurality of links and the second plurality of links to place the seat of the seating unit at an angle relative to horizontal of between eighteen and twenty-six degrees.

15 Claims, 15 Drawing Sheets

(56) References Cited

U.S. PATENT DOCUMENTS

2010/0127538 A1* 5/2010 Hoffman ..... A47C 3/18 297/68
2010/0127555 A1* 5/2010 Hoffman ..... A47C 3/0255 297/85 M
2010/0127556 A1* 5/2010 Hoffman ..... A47C 3/0255 297/85 R
2011/0018331 A1* 1/2011 Murphy ..... A47C 1/0355 297/85 R
2011/0175404 A1* 7/2011 Lawson ..... A47C 1/0355 297/83
2011/0175426 A1* 7/2011 Lawson ..... A47C 1/0355 297/85 M
2011/0181094 A1* 7/2011 Lawson ..... A47C 1/035 297/85 R
2011/0233972 A1* 9/2011 Weicek ..... A47C 1/0355 297/84
2012/0049606 A1* 3/2012 Lawson ..... A47C 1/0355 297/85 M
2012/0104827 A1* 5/2012 Murphy ..... A47C 1/0345 297/85 M
2012/0112519 A1* 5/2012 Murphy ..... A47C 1/0355 297/85 M
2012/0235449 A1* 9/2012 Wiecek ..... A47C 1/0342 297/84
2012/0286557 A1 11/2012 Hoffman et al.
2012/0299363 A1* 11/2012 Crum ..... A47C 1/0352 297/85 M
2013/0175847 A1* 7/2013 Lawson ..... A61G 5/14 297/85 M
2014/0035395 A1 2/2014 Marcantoni
2014/0049084 A1* 2/2014 Lawson ..... A47C 1/032 297/340
2014/0070585 A1 3/2014 LaPointe
2014/0327282 A1* 11/2014 Crum ..... A47C 3/02 297/259.2
2014/0333099 A1* 11/2014 Lu ..... A47C 1/0355 297/83
2014/0368011 A1 12/2014 Lapointe
2015/0054315 A1 2/2015 Donovan et al.
2015/0208805 A1 7/2015 Griggs, Jr.
2015/0289655 A1 10/2015 Lawson
2016/0022040 A1* 1/2016 Lawson ..... A47C 1/0355 297/68
2016/0029800 A1* 2/2016 Bryant ..... A47C 1/0242 297/284.3
2016/0045031 A1* 2/2016 Lawson ..... A47C 1/0355 297/284.3
2016/0273632 A1* 9/2016 Lawson ..... F16H 25/20
2017/0258230 A1* 9/2017 Huang ..... A47C 17/1756
2018/0027965 A1* 2/2018 Lawson ..... A47C 3/0255
2018/0027967 A1* 2/2018 Lawson ..... A47C 1/0352
2018/0027968 A1 2/2018 Lawson et al.
2018/0242740 A1* 8/2018 Lawson ..... A47C 1/024
2018/0242744 A1* 8/2018 Lawson ..... A47C 1/0345
2019/0216221 A1* 7/2019 Bryant ..... A47C 1/0347
2019/0290004 A1* 9/2019 Lawson ..... A47C 1/121
2019/0290005 A1* 9/2019 Bryant ..... A47C 1/0355
2019/0350368 A1* 11/2019 Lapointe ..... A47C 1/022
2020/0113333 A1* 4/2020 Crum ..... A47C 1/0355

OTHER PUBLICATIONS

International Search Report and Written Opinion received for PCT Application No. PCT/US2019/062462, dated Jan. 17, 2020, 10 pages.

* cited by examiner

ZERO-WALL CLEARANCE LINKAGE MECHANISM WITH POWER SEAT DRIVE

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the disclosure relates to an improved metal to the floor, zero-wall linkage mechanism for use on motorized chairs offering an increased seat pitch, and elevated ottoman in the fully-reclined position. This new fully-reclined position can offer more comfort for users, such as by taking pressure off of a user's back, while still allowing a more-standard fully-reclined position with less seat pitch if desired.

Reclining seating units exist that allow a user to extend a footrest forward and to recline a backrest rearward relative to a seat. These existing seating units typically provide three basic positions (e.g., a standard, non-reclined closed position; an extended position (TV position); and a fully-reclined position). In the closed position, the seat resides in a generally horizontal orientation and the backrest is disposed substantially upright. The seating unit includes one or more ottomans that are collapsed or retracted in the closed position, such that the ottomans are not extended. In the extended position, often referred to as a television ("TV") position, the ottomans are extended forward of the seat, and the backrest remains sufficiently upright to permit comfortable television viewing by an occupant of the seating unit. In the fully-reclined position, the backrest is pivoted rearward from the extended position into an obtuse relationship with the seat for lounging or sleeping, while the ottoman remains extended.

Several modern seating units in the industry are adapted to provide the adjustment capability described above. However, in the fully-reclined position of these seating units, the seat only slightly drops in the rear, if at all. For example, in some prior art seating units, the seat angle, from front to back, might drop about eight degrees relative to horizontal. This seat pitch might increase slightly in the TV position to about twelve degrees. And, in the fully-reclined position, the seat pitch might increase slightly again to about thirteen degrees. So, in these existing seating units, the seat pitch might change only about five degrees relative to horizontal as the seating unit moves from the closed to the fully-reclined position. It would be beneficial to provide consumers the ability to recline further, such that the ottoman rises further above the support surface (floor) and the seat pitch increases more dramatically, to allow for more of a "zero-gravity" position. It has been found that some users find added comfort with their feet further elevated. As such, a linkage mechanism that allows this additional movement, while still providing the option of a more standard closed, extended, and reclined positions would fill a void in the current field of motion-upholstery technology.

SUMMARY

Aspects seek to provide a novel linkage mechanism that efficiently moves a seating unit among the four positions: closed, TV, reclined and fully-reclined. In the fully-reclined position, the seat is angled further relative to horizontal (inclining up from the back of the chair to the front) and the ottoman is further elevated from the support surface. In some aspects, the seat is angled between eighteen and twenty-six degrees, and in some aspects, the ottoman is elevated an additional four to seven degrees above the support surface by the mechanism as compared to the reclined position.

In some aspects, a metal-to-the-floor linkage mechanism provides backrest recline and ottoman extension for a seating unit. The linkage mechanism comprises a base and a pair of spaced, opposed seat mounting plates, spaced apart from the base. The pair of seat mounting plates are used to attach a seat to the mechanism. The linkage mechanism further comprises a first plurality of links and a second plurality of links. Each of the first plurality of links and the second plurality of links are pivotally coupled between the base and a corresponding one of the pair of seat mounting plates. The first and second plurality of links moveably interconnect the base and the seat mounting plates to control movement of the seating unit between closed, TV, reclined and fully-reclined positions. In the fully-reclined position, the seat mounting plates are moved to a position by the first plurality of links and the second plurality of links to place the seat of the seating unit at an angle relative to horizontal of between eighteen and twenty-six degrees.

BRIEF DESCRIPTION OF THE SEVERAL VIEWS OF THE DRAWINGS

In the accompanying drawings which form a part of the specification and which are to be read in conjunction therewith, and in which like reference numerals are used to indicate like parts in the various views.

DETAILED DESCRIPTION OF THE INVENTION

Figure 15:
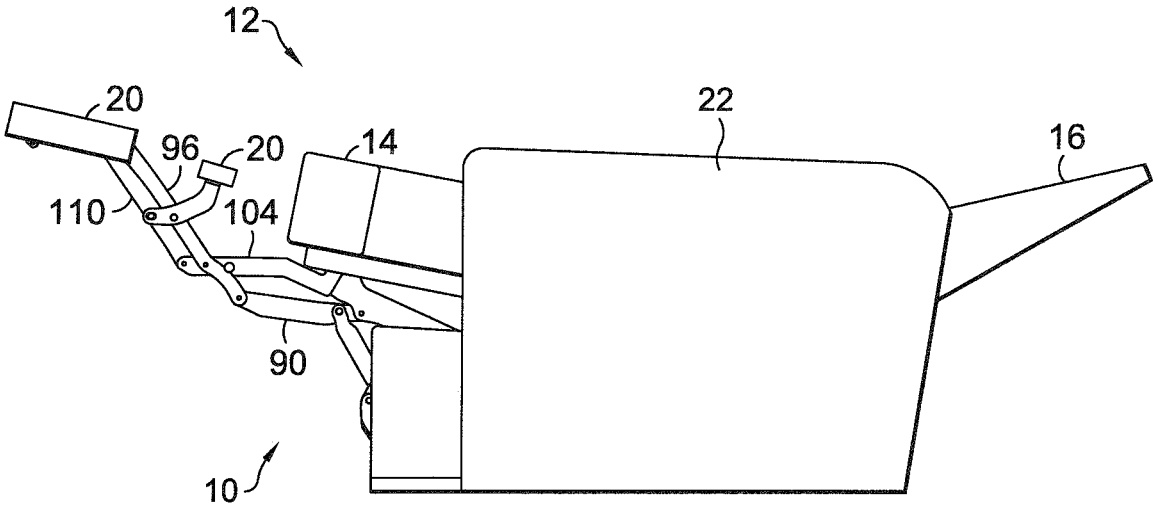
FIG. 15 is a side view of a seating unit having the mechanism of FIGS. 1-14, shown in the fully-reclined position.

FIGS. 1-11 illustrate a first aspect of a linkage mechanism 10 for use on a motion seating unit 12, as shown in FIG. 15. Seating unit 12 has a seat 14, a backrest 16, one or more ottoman(s) 20, and a pair of opposed arms 22. The linkage mechanism 10 couples the seat 14, the backrest 16, and the ottoman(s) 20 together to move the seating unit 12 between closed, TV, reclined, and fully-reclined positions, as is more fully described below.

Figure 1:
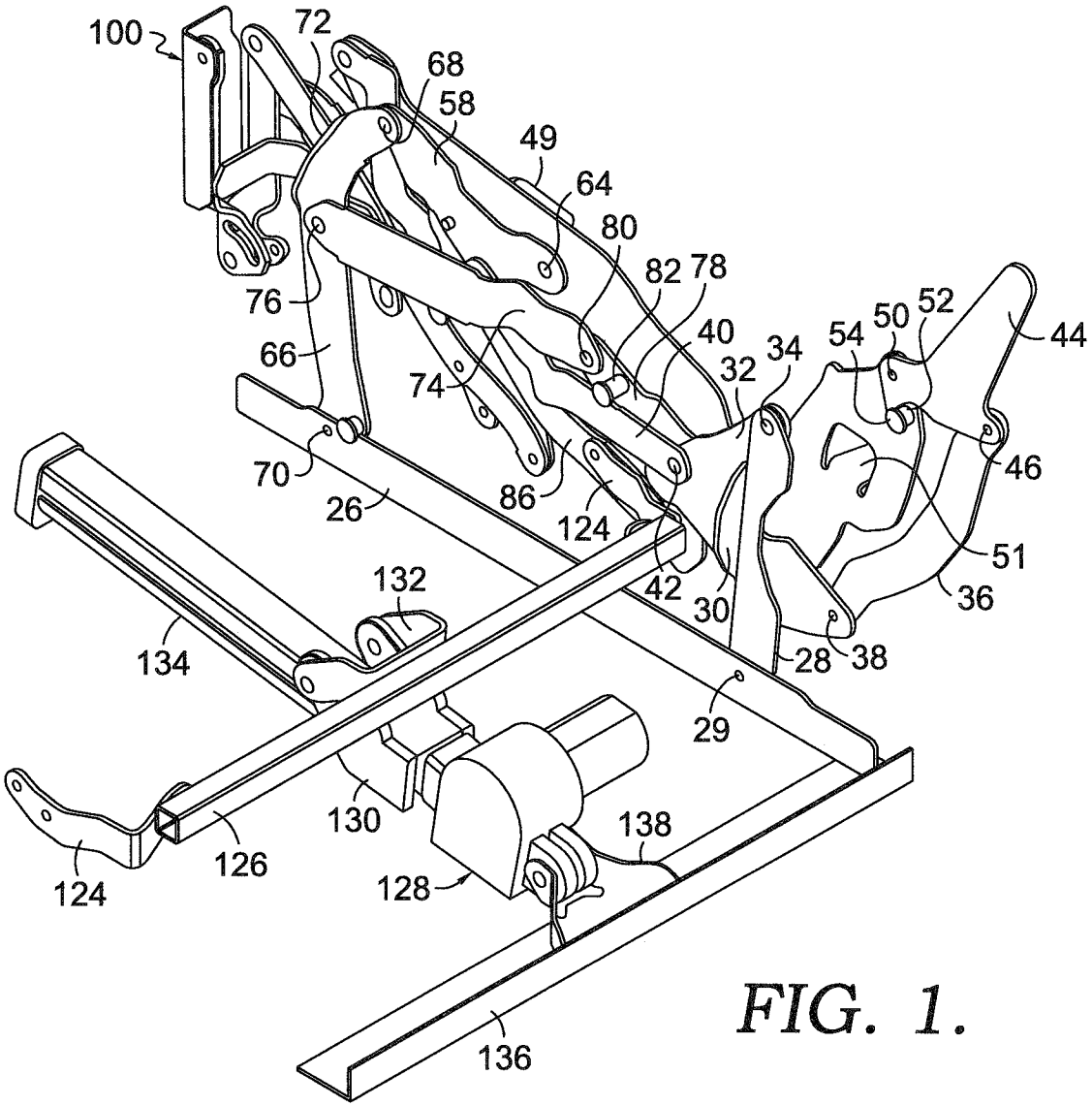
FIG. 1 is a perspective view of a mechanism for a seating unit in a closed position, with one side removed for clarity.
Figure 2:
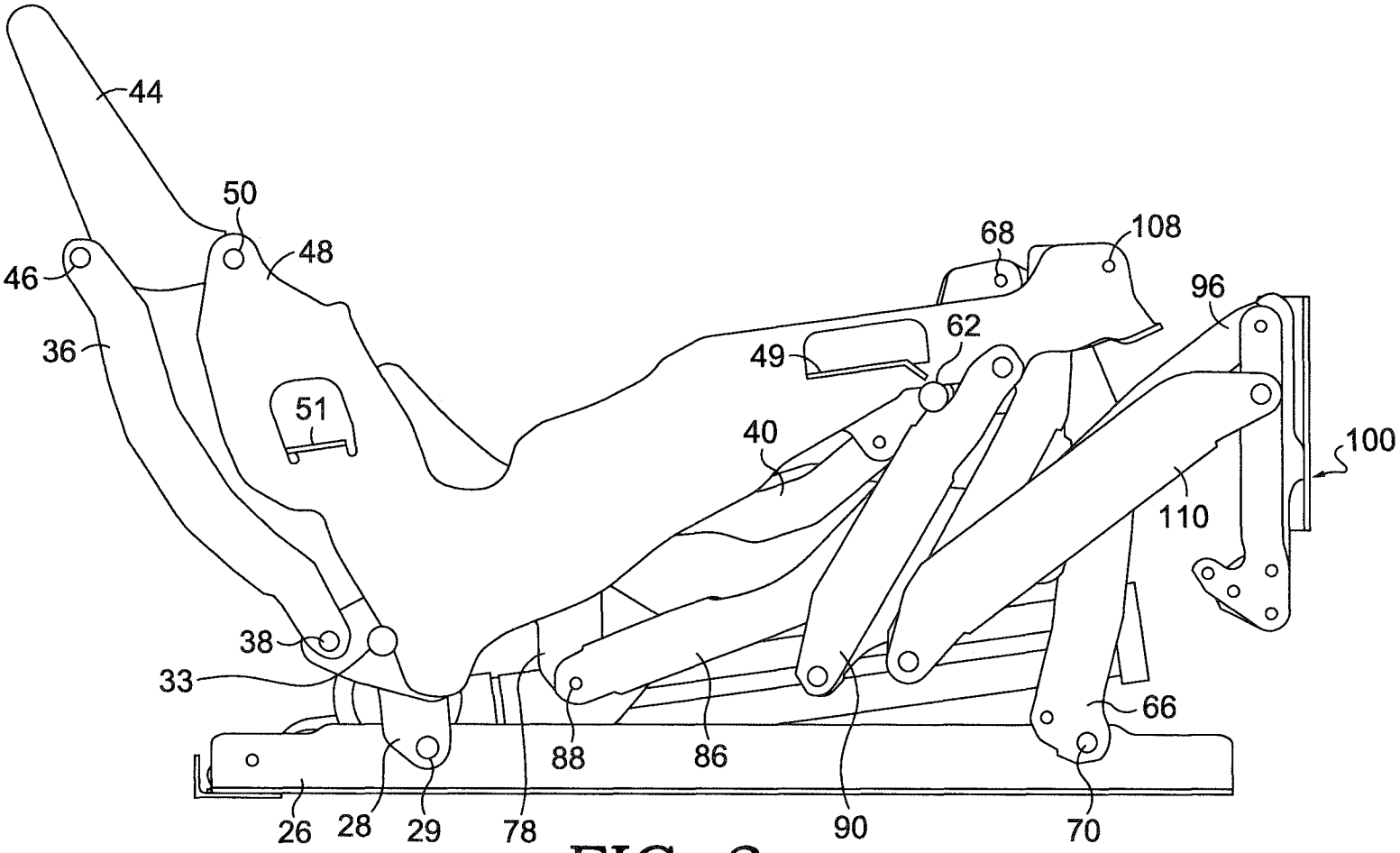
FIG. 2 is a side view of the mechanism of FIG. 1.
Figure 3:
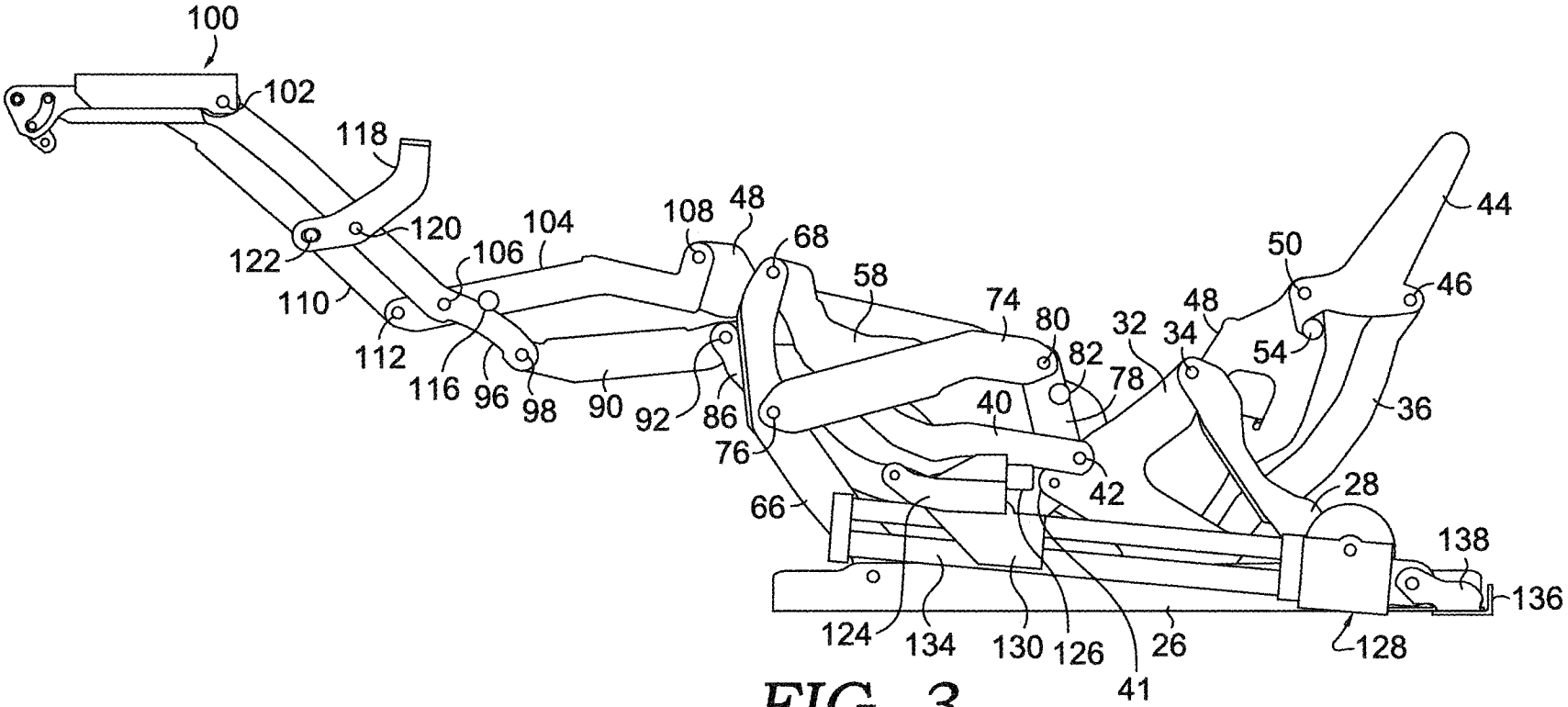
FIG. 3 is a side view of a mechanism of FIG. 1, but in the TV position.
Figure 6:
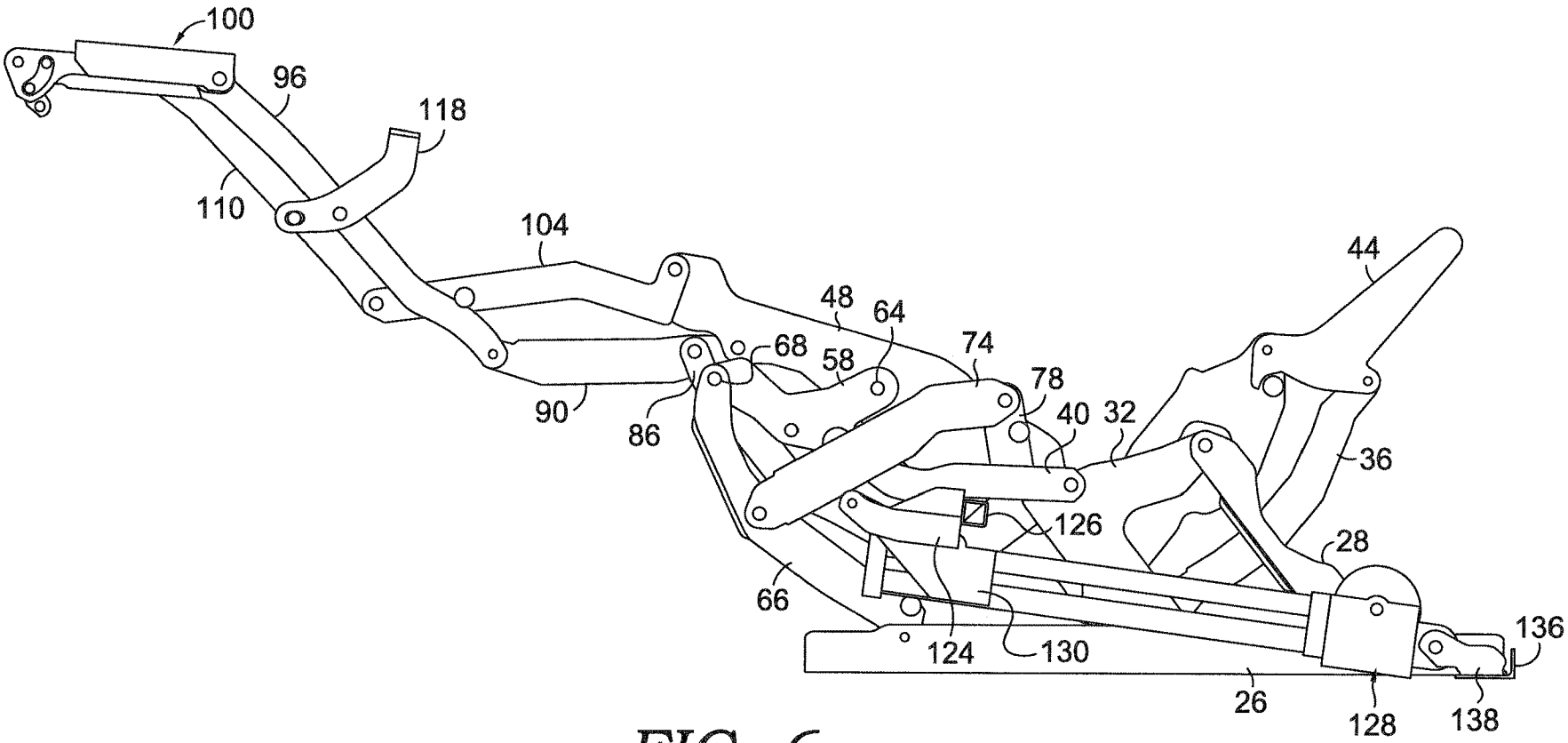
FIG. 6 is a side view similar to FIG. 3, but in the reclined position.
Figure 7:
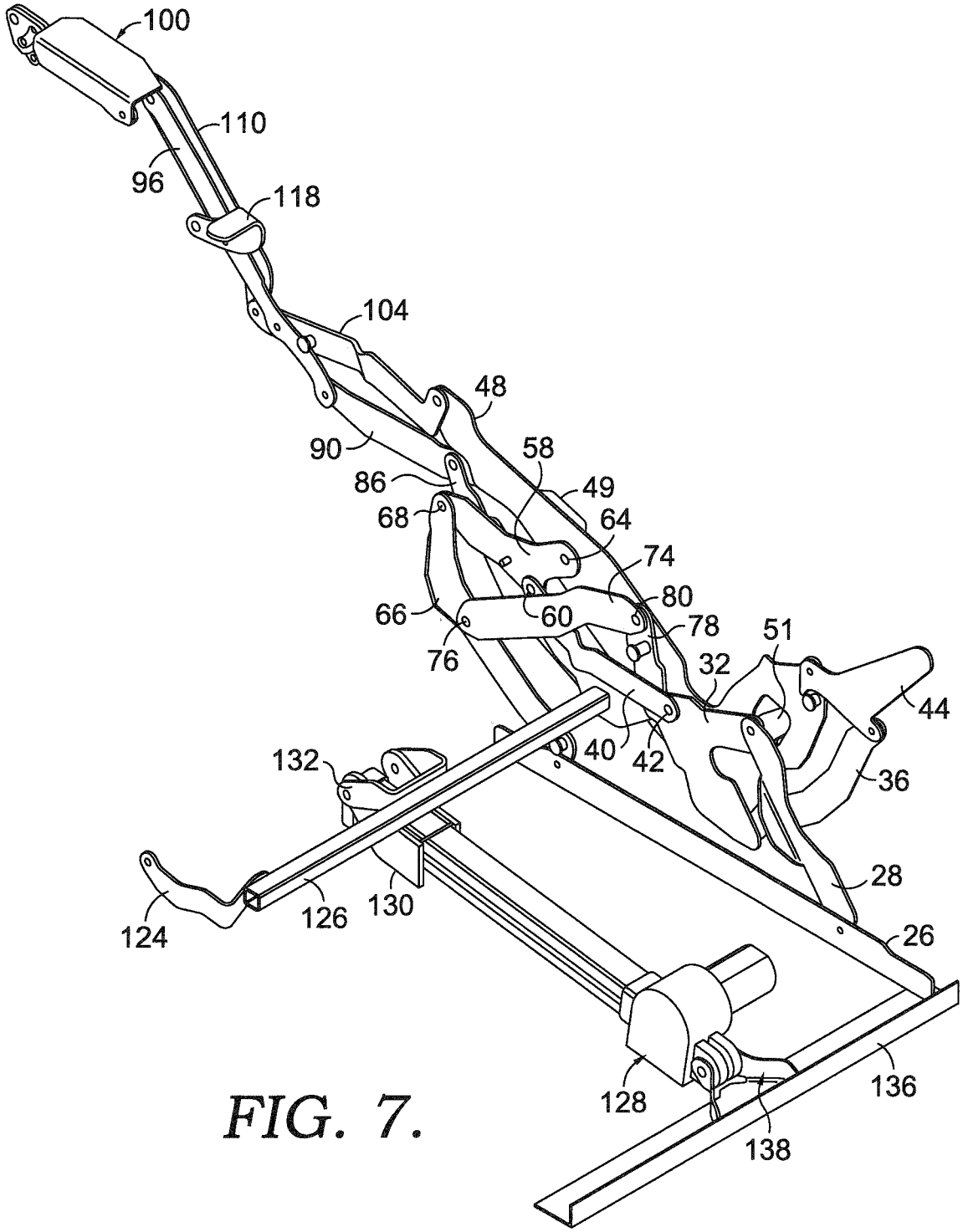
FIG. 7 is a perspective view of the mechanism of FIG. 6.
Figure 8:
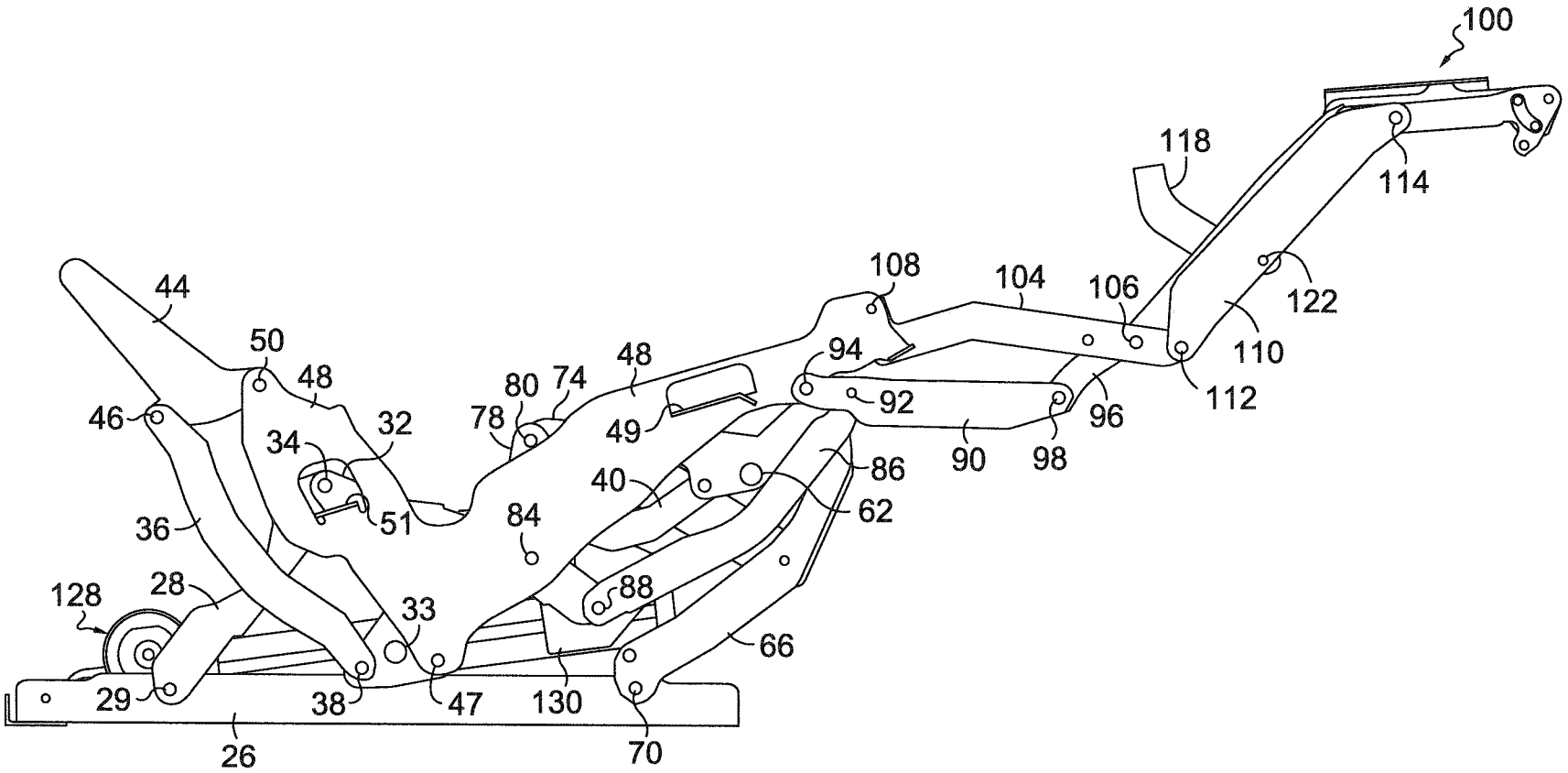
FIG. 8 is a side view of the mechanism of FIG. 6, shown from the other side.
Figure 9:
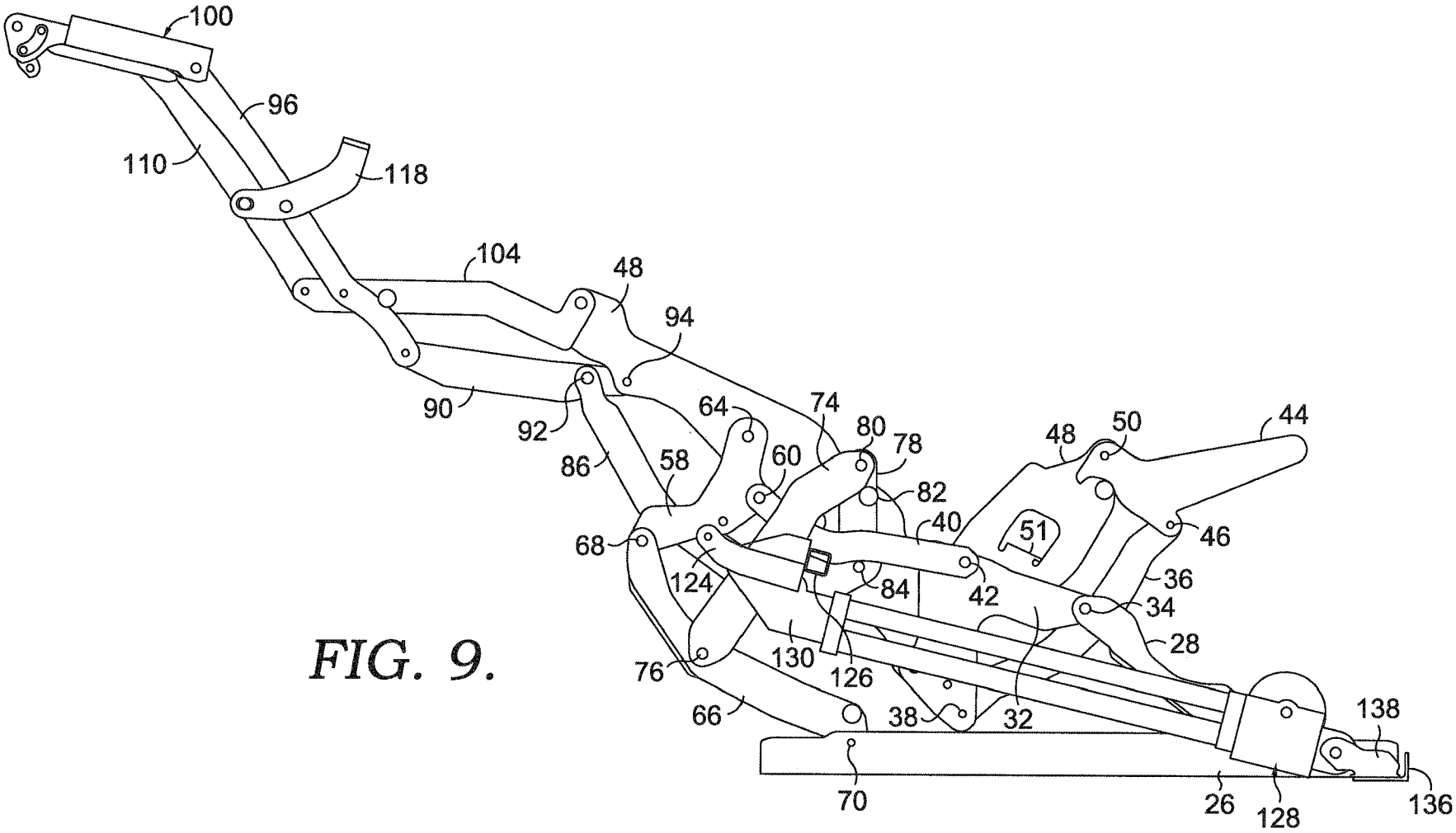
FIG. 9 is a side view similar to FIG. 6, but in the fully-reclined position.
Figure 10:
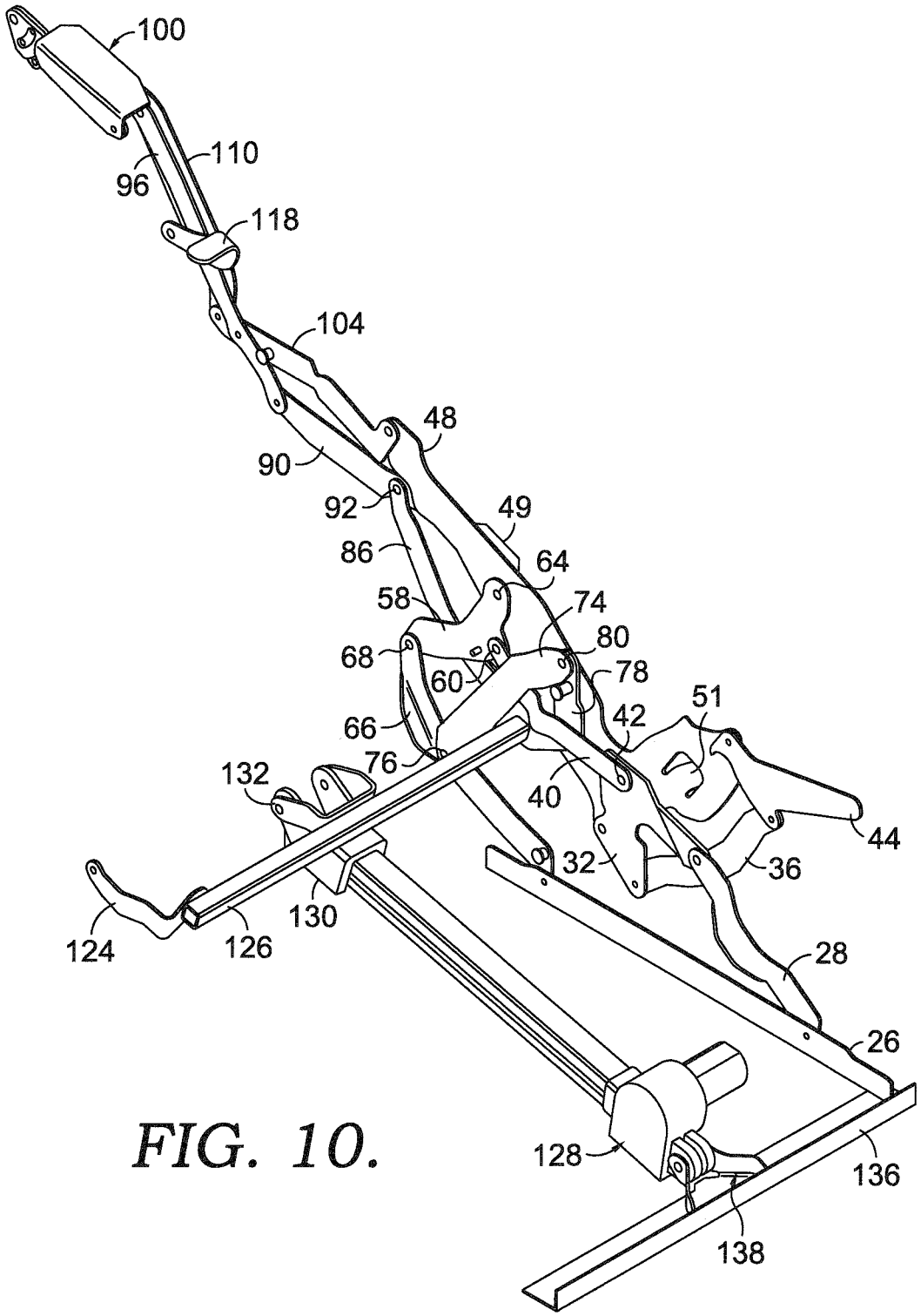
FIG. 10 is a perspective view of the mechanism of FIG. 9.
Figure 11:
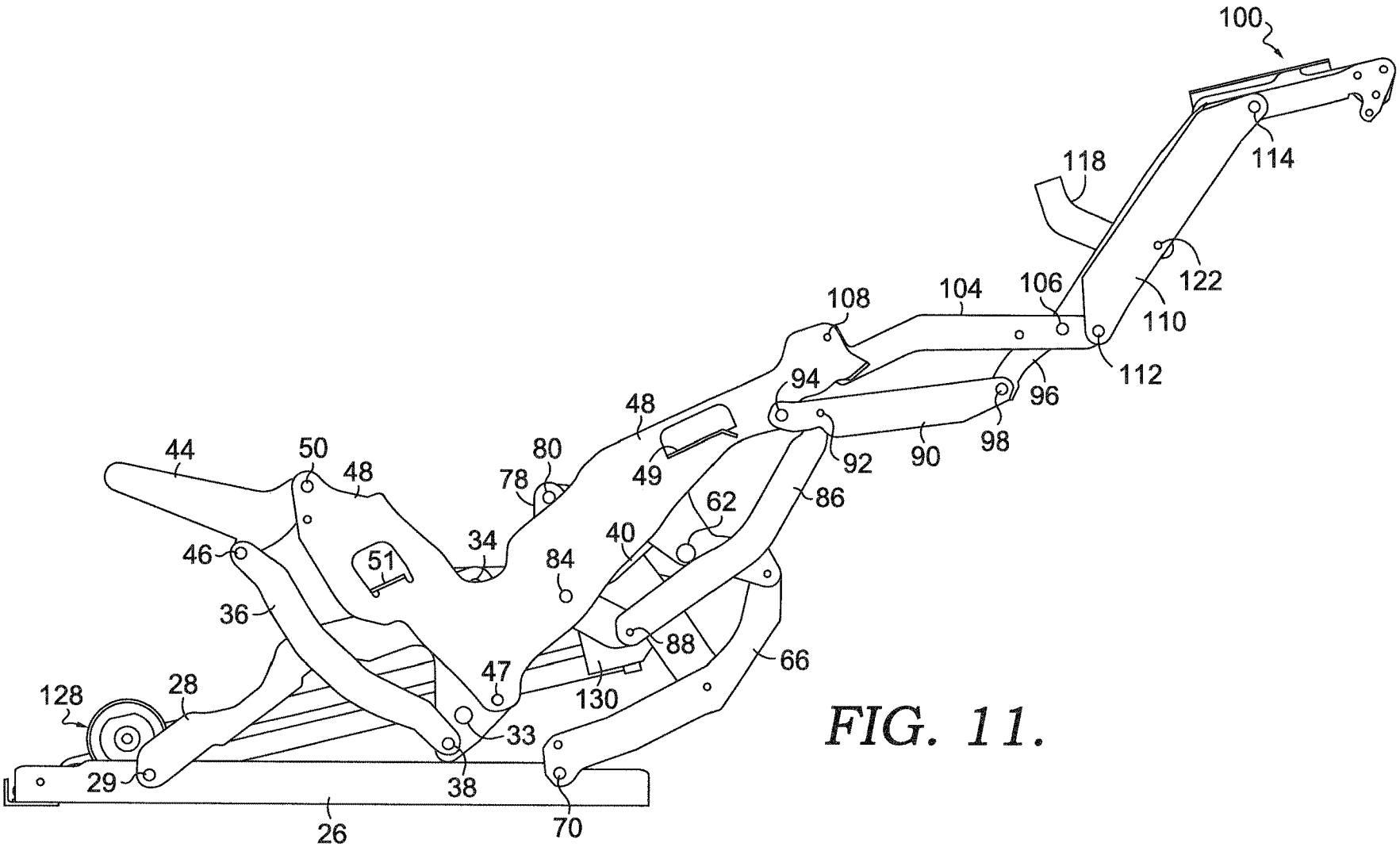
FIG. 11 is a side view of the mechanism of FIG. 9, shown from the other side.

As shown in FIGS. 1-11, linkage mechanism 10 is adjustable to four basic positions: a closed position (FIGS. 1-2), an extended or TV position (FIGS. 3-5), a reclined position (FIGS. 6-8), and a fully-reclined position (FIGS. 9-11). Additionally, only one side of linkage mechanism 10 is shown, with the other side being a mirror-image of the side shown and described. FIG. 1 depicts the linkage mechanism 10 adjusted to the closed position, which is a normal, non-reclined sitting position with the seat 14 in a generally horizontal position and the backrest 16 generally upright and in a substantially perpendicular position relative to the seat 14. Note that FIGS. 1-11 show the linkage mechanism 10 with the outer parts of the seating unit 12 removed for clarity. In particular, in the closed position, the seat 14 is disposed in a slightly inclined orientation relative to the floor, in some aspects the seat is inclined about eight degrees relative to horizontal in the closed position. When adjusted to the closed position, the ottoman 20 is retracted and is positioned below the seat 14. FIG. 3 depicts the extended, or TV, position. When the linkage mechanism 10 is adjusted to the extended position, the ottoman 20 is extended forward so it is generally horizontal. However, the backrest 16 remains substantially perpendicular to the seat. Also, the seat 14 is maintained in generally the same orientation relative to the floor, with the angle increasing slightly in some aspects to about twelve degrees. Typically, the seat 14 is translated slightly forward and the angle of inclination of the seat changes slightly as the rear of the seat slightly drops. FIG. 6 depicts the reclined position. In the reclined position, the backrest 16 is rotated rearward by the linkage mechanism 10. However, the rearward movement of the backrest 16 is offset by a forward and upward translation of the seat 14 as controlled by the linkage mechanism 10. The forward and upward translation of the seat 14 in aspects of the present invention allows for "zero-wall" clearance. Generally, "zero-wall" clearance is used herein to refer to a space-saving utility that permits positioning the seating unit 12 in close proximity to an adjacent rear wall and other fixed objects. In the reclined position, the seat 14 may be further angled, and in some aspects the angle of inclination relative to horizontal is about thirteen degrees. FIG. 9 illustrates the linkage mechanism 10 in the fully-reclined position. In this position, the height of the ottoman above the support surface increases, such that a user's feet are further above the support surface. Additionally, the seat 14 may be still further angled, and in some aspects the angle of inclination relative to horizontal is about thirteen degrees, and in some aspects is in the range of 15-26 degrees. In one aspect, the angle of inclination of the seat, relative to horizontal is about twenty-four degrees.

As described below, the linkage mechanism 10 comprises a plurality of links that are arranged to actuate and control movement of the seating unit 12 during movement between the closed, extended, reclined and fully-reclined positions. These links may be pivotally interconnected. The pivotal couplings (illustrated as pivot points in the figures) between these links can take a variety of configurations, such as pivot pins, bearings, traditional mounting hardware, rivets, bolt and nut combinations, or any other suitable fasteners, which are well known in the furniture-manufacturing industry. Further, the shapes of the links and the brackets may vary, as may the locations of certain pivot points. It will be understood that when a link is referred to as being pivotally "coupled" to, "interconnected" with, "attached" on, etc., another element (e.g., link, bracket, frame, and the like), it is contemplated that the link and elements may be in direct contact with each other or other elements, such as intervening elements, which may also be present. Not all reference numerals are listed on all figures, for clarity, but the same parts numbered in one figure correspond to similar parts numbered in other figures.

Generally, the linkage mechanism 10 guides the coordinated movement of the backrest 16, the seat 14, and the ottoman(s) 20. In an exemplary configuration, these movements are controlled by a pair of essentially mirror-image linkage mechanisms (one of which is shown herein and indicated by reference numeral 10), which comprise an arrangement of pivotal interconnected linkages. The linkage mechanisms 10 are disposed in opposing-facing relation about a longitudinally extending plane that bisects the seating unit 12 between the pair of opposed arms 22. As such, the ensuing discussion will focus on only one of the linkage mechanisms 10, with the content being equally applied to the other complimentary linkage mechanism.

Figure 4:
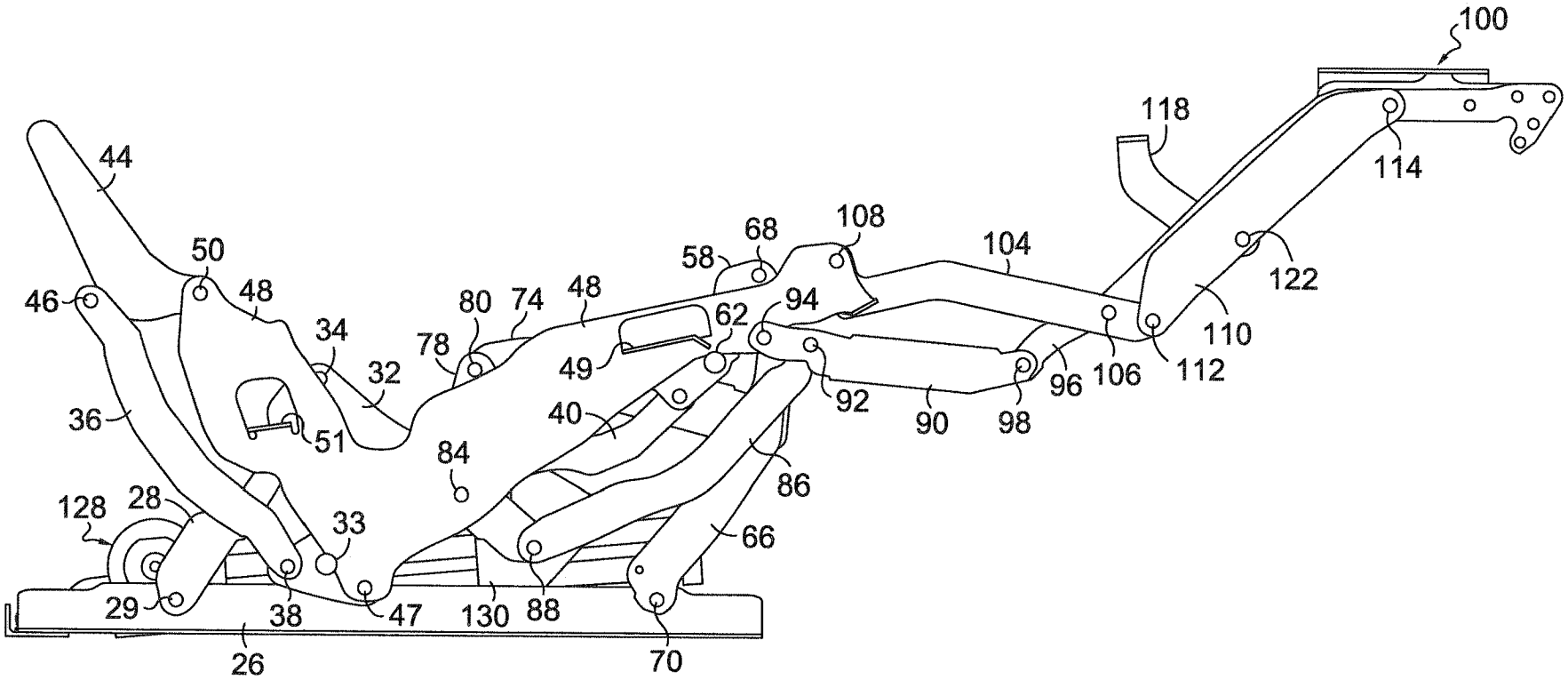
FIG. 4 is a side view, similar to FIG. 3, but shown from the other side.
Figure 5:
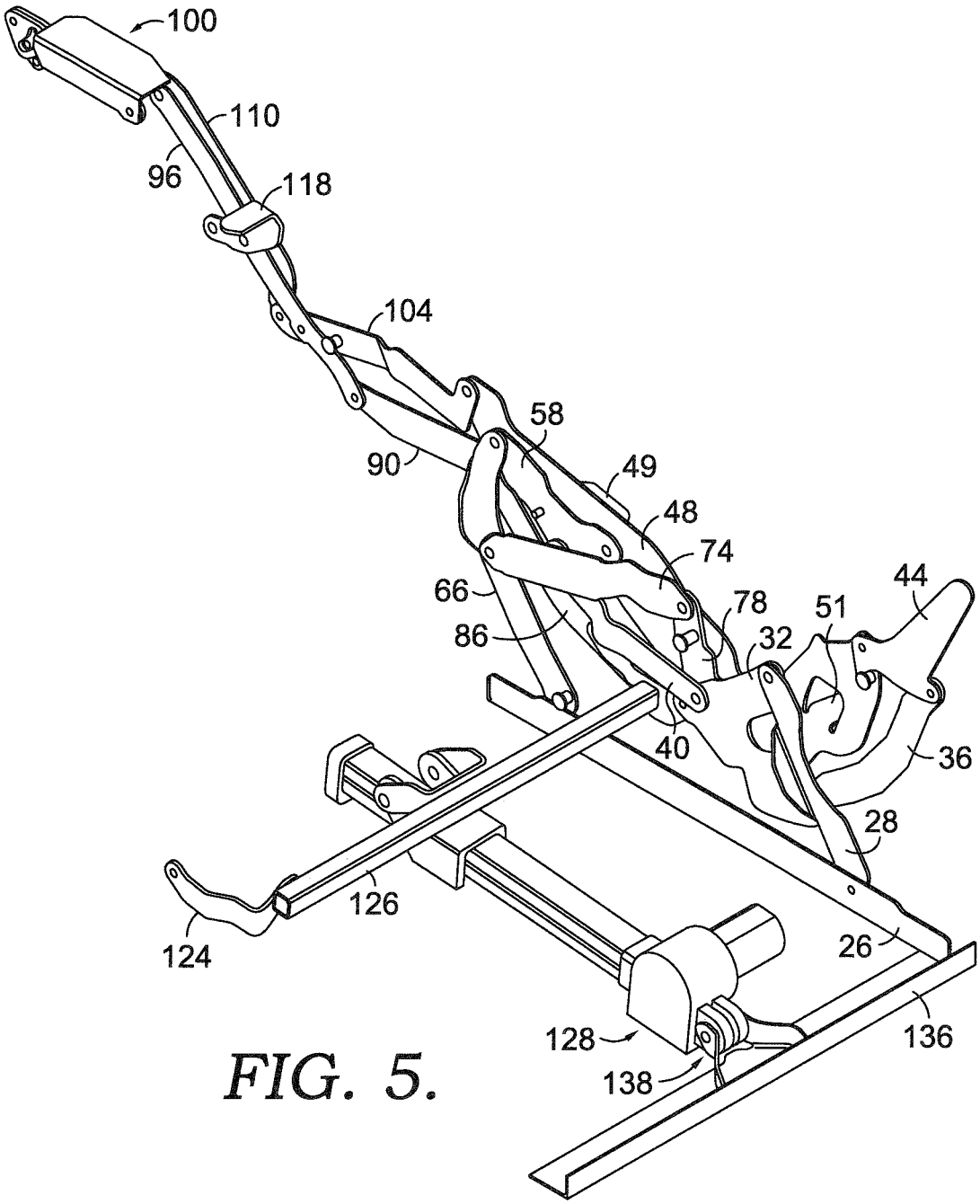
FIG. 5 is a perspective view of the mechanism of FIG. 4.

FIGS. 1-11 illustrate the configuration of linkage mechanism 10 in a first aspect, for a motorized, zero-wall clearance, metal-to-the-floor seating unit 12. Linkage mechanism 10 has a pair of parallel, spaced sides, one left and one right, although only one side is shown in the figures for clarity. Each side of linkage mechanism 10 includes a side rail 26 that extends from the front of the seating unit 12 to the back. Rails 26 are used to mount the linkage mechanism 10 to the base of the seating unit 12 and operate as the base of the linkage mechanism 10. The linkage mechanism 10 on one side of the seating unit includes a first plurality of links, and the linkage mechanism 10 on the other side includes a corresponding second plurality of links. More specifically, a rear pivot link 28 extends upwardly from the rail 26 and is pivotally connected to the rail 26 at a lower end thereof at pivot point 29. Unless otherwise described differently, each of the rails, links, and brackets described herein are typically made of formed or stamped steel, but other materials with similar characteristics could be used. Rear pivot link 28 has an outward extension 30 formed generally between its ends that functions to couple a rear cross tube between the left and right mechanisms 10 to provide stability to the linkage mechanism 10. The upper end of rear pivot link 28 is pivotally coupled to a rear lift link 32 at pivot 34. Rear lift link 32 is also pivotally coupled to a rear control link 36 at pivot 38. Rear lift link 32 is also pivotally coupled to a connector link 40 at pivot 42. In some aspects, pivot point 42 is located further rearwardly from a forward point 41 of rear lift link 32 than in prior mechanisms, which, in part, allows the linkage mechanism 10 to achieve the fully-reclined position of FIGS. 6-9. Finally, rear lift link 32 is pivotally coupled to a seat mounting plate 48 at pivot point 47, as best seen in FIGS. 2 and 4. As can be seen, rear lift link 32 is somewhat triangularly shaped and connects the rear pivot link 28, the rear control link 36, the connector link 40 and the seat mounting plate 48. As best seen in FIG. 2, a stop pin 33 is rigidly secured to rear lift link 32 that operates to keep seat mounting plate 48 in position as stop pin 33 contacts a notch formed in seat mounting plate 48. Seat mounting plate 48 is shaped as shown to facilitate the described connections. Seat mounting plate also has a front seat mounting tab 49 and a rear seat mounting tab 51 that form the coupling points to seat 14. In some aspects, the front seat mounting tab 49 and the rear seat mounting tab 51 form a plane that corresponds to the plane of the seat 14.

The rear control link 36 is coupled on one end to the rear lift link 32 at pivot 38. The rear control link 36 extends upwardly, and is pivotally connected to a back mounting link 44 at its other end, at pivot 46. Rear control link 36 is thus pivotally connected between rear lift link 32 and back mounting link 44. Back mounting link 44 has a forward end that is pivotally coupled to seat mounting plate 48 at pivot 50. As best seen in FIG. 1, near pivot 50, back mounting link 44 has a lower surface 52 that contacts a stop 54 that is rigidly coupled to seat mounting plate 48. The upper end of back mounting link 44 is used to couple the backrest 16 of seating unit 12 to the linkage mechanism 10. As back mounting link 44 pivots rearwardly, the backrest 16 is reclined.

Returning to connector link 40, it can be seen that one end of connector link 40 is pivotally coupled to rear lift link 32 at pivot 42. The opposite, forward end of connector link 40 is pivotally coupled to an elongated, somewhat L-shaped, front lift link 58 at pivot 60 (see FIGS. 7 and 9). As best seen in FIG. 7, in some aspects connector link 40 has an outward bend section to provide clearance for other links of linkage mechanism 10. The outer end of one leg of front lift link 58 is pivotally coupled to seat mounting plate 48 at pivot 64. The outer end of the other leg of front lift link 58 is pivotally coupled to a front pivot link 66 at pivot 68. Front lift link 58 is thus pivotally connected to connector link 40, seat mounting plate 48, and front pivot link 66. As best seen in FIGS. 4 and 11, front lift link 58 has a stop pin 62 rigidly secured thereto and extending therefrom.

Front pivot link 66 is coupled on one end to the front lift link 58 and is pivotally coupled on the opposite, lower end to side rail 26 at pivot 70. Front pivot link 66, in some aspects, has an extension 72 that allows for a front cross-tube to be mounted between the pair of front pivot links 66 and couples the linkage mechanisms 10 together for added stability, connecting the two sides together.

A carrier link 74 is pivotally coupled to front pivot link 66 at pivot 76 generally midway between pivots 68 and 70. Carrier link 74 extends from pivot 76 and is coupled on its other end to a front bell crank 78 at pivot 80. As with connector link 40, in some aspects carrier link 74 has a bend section to provide clearance for the other links of linkage mechanism 10.

As best seen in FIG. 10, front bell crank 78 has a somewhat boomerang shape, as shown. One end of front bell crank 78 is pivotally coupled to carrier link 74 at pivot point 80. Generally, at the midpoint, front bell crank 78 is pivotally coupled to seat mounting plate 48 at pivot 84 (see FIGS. 4, 9 and 11). The opposite end of front bell crank 78 is pivotally coupled to an ottoman drive link 86 at pivot 88. As best seen in FIG. 1, front bell crank 78 has a stop pin 82 coupled to it just below pivot point 80 that abuts connector link 40 in the closed position.

As best seen in FIG. 4, the end of ottoman drive link 86 opposite pivot 88 is pivotally coupled to rear ottoman link 90 at pivot 92. Rear ottoman link 90 is pivotally coupled at its top end to seat mounting plate 48 at pivot 94. The lower end of rear ottoman link 90 is pivotally coupled to a top ottoman link 96 at pivot 98. As best seen in FIG. 3, the top ottoman link 96 is part of the ottoman linkage and is pivotally coupled at its opposite end to an ottoman bracket assembly 100 at pivot 102. Ottoman bracket assembly 100 is connected to and supports ottoman 20. Near pivot 98, top ottoman link 96 is pivotally coupled to a front ottoman link 104 at pivot 106. One end of front ottoman link 104 is pivotally coupled to seat mounting plate 48 at pivot 108. The other end of front ottoman link 104 is pivotally coupled to a lower ottoman link 110 at pivot 112. Opposite pivot 112, lower ottoman link 110 is pivotally coupled to ottoman bracket assembly 100 at pivot 114 (see FIG. 4). As best seen in FIG. 3, front ottoman link 104 has a stop pin 116 rigidly secured near pivot 106. Stop pin 116 stops the extension of the ottoman linkage at the desired location. In some aspects, the ottoman linkage includes a mid-ottoman, supported by a mid-ottoman bracket 118. Mid-ottoman bracket 118 is pivotally coupled to top ottoman link 96 at pivot 120 and is also pivotally coupled to lower ottoman link 110 at pivot 122.

As best seen in FIG. 1, a drive tube mounting bracket 124 is rigidly secured to ottoman drive link 86 near pivot 88. Drive tube mounting bracket 124 is used to secure a font motor tube 126 between the ottoman drive link 86 on each linkage mechanism 10. A front motor bracket 132 is rigidly secured to front motor tube 126 at its midpoint. The front motor bracket 132 is used to pivotally couple the front motor tube 126 to a guide block 130 on a motor 128. Motor 128 moves the guide block 130 along a shaft 134 of motor 128. Motor 128 extends between the front motor tube 126 and a rear cross rail 136 that extends between the two side rails 26. To facilitate that connection, a rear motor bracket 138 is formed or secured to rear cross rail 136, generally at the mid-point of rear cross rail 136. In some aspects, a front cross rail similarly extends between the two side rails 26 to connect the two sides of linkage mechanism 10 together. The front cross rail, rear cross rail 136 and side rails 26 form the base of the metal-to-the-floor linkage mechanism. The motor 128 can be operated to extend and retract guide block 130, moving the front motor tube 126 and thus moving the linkage mechanisms 10 between the closed, TV, reclined and fully reclined positions.

More specifically, in operation, the motor 128 can be activated to extend guide block 130 when the linkage mechanism 10 is in the closed position of FIGS. 1 and 2. Extension of the guide block operates to move the front motor tube 126 in a forward direction. Due to the connection to ottoman drive link 86, the movement of front motor tube 126 extends the ottoman bracket assembly 100 to the TV position of FIGS. 3-5. Movement of ottoman drive link 86 causes a rotation of front bell crank 78 about pivot 84 and causes the pivotal connection between front bell crank 78 and ottoman drive link 86 to move forwardly. This movement also drives (as viewed from the perspective of FIG. 4) a counterclockwise rotation of rear ottoman link 90 about pivot 94. As rear ottoman link 90 rotates, the ottoman bracket assembly 100 is moved to the extended position shown in FIG. 4 by the interconnection of links 90, 96, 104, and 110. The stop pin 116 prevents over extension of the ottoman linkage.

As the seat mounting plate 48 moves forward, the seat 14 translates forwardly, and the angle of seat mounting plate 48 relative to horizontal increases slightly, as rear lift link 32, connector link 40 and front lift link 58 (along with rear pivot link 28 and front pivot link 66) control the movement and angle of seat mounting plate 48. In one aspect, the seat mounting plate 48 (and more specifically the plane formed by front seating mounting tab 49 and rear seat mounting tab 51) moves from an angle of inclination (relative to horizontal) of about eight degrees in the closed position to about twelve degrees in the TV position. In this TV position, the back mounting link 44 remains in substantially the same orientation so that the back 16 remains substantially upright.

Further activation of motor 128 causes additional forward force on seat mounting plate 48, acting through front motor tube 126, and ottoman drive link 86. The stop pin 116 prevents further extension of the ottoman linkage. As the seat mounting plate 48 is urged forwardly, front lift link 58 rotates, lifting the front of seat mounting plate 48. This further movement also causes a rotation of rear lift link 32, which pulls the bottom of rear control link 36 forward and downward. As rear control link 36 rotates and moves, it causes back mounting link 44 to rotate about pivot 50, thus acting to recline the back 16. Because the seat mounting plate 48 moves forwardly as the linkage mechanism 10 moves to the fully reclined position, the linkage mechanism 10 affords a zero-wall clearance for the seating unit 12. In the reclined position of FIGS. 6-8, the seat mounting plate 48 (and more specifically the plane formed by front seating mounting tab 49 and rear seat mounting tab 51) moves from an angle of inclination (relative to horizontal) of about twelve degrees in the TV position to about thirteen degrees in the reclined position. This reclined position of FIGS. 6-8, is similar in some aspects to a fully-reclined position of prior art mechanisms. The motor 128 however, can further move the linkage mechanisms 10 to the fully-reclined position shown in FIGS. 9-11. As the motor 128 moves the guide block 130, the front motor tube 126 moves the linkage mechanism 10 to the fully-reclined position, rotating rear lift link 32 and front lift link 58, and constrained by connector link 40. The connector link 40 is coupled to rear lift link 32 at pivot 42 in a location that differs from prior seating units. The location of pivot 42, and the connection of connector link 40 to front lift link 58 cause the pivot 64 (coupling front lift link 58 to seat mounting plate 48) to lift more than prior seating units. In the fully-reclined position of FIGS. 9-11, the seat mounting plate 48 (and more specifically the plane formed by front seating mounting tab 49 and rear seat mounting tab 51) moves from an angle of inclination (relative to horizontal) of about thirteen degrees in the reclined position to about twenty-four degrees in the fully-reclined position, in one aspect. In some aspects, the angle of inclination (relative to horizontal) is above eighteen degrees. In other aspects, the angle of inclination (relative to horizontal) is up to twenty-six degrees. This additional angle of inclination of the seat 14, along with a corresponding lift in the ottoman 20 has been found to be desirable for some users. In the fully-reclined position, the ottoman bracket assembly 100 is lifted or elevated further from the underlying support surface, as compared to the reclined position. In some aspects, the ottoman bracket assembly 100 is lifted or elevated from between four and seven inches further from the underlying support surface, as compared to the reclined position.

Figure 12:
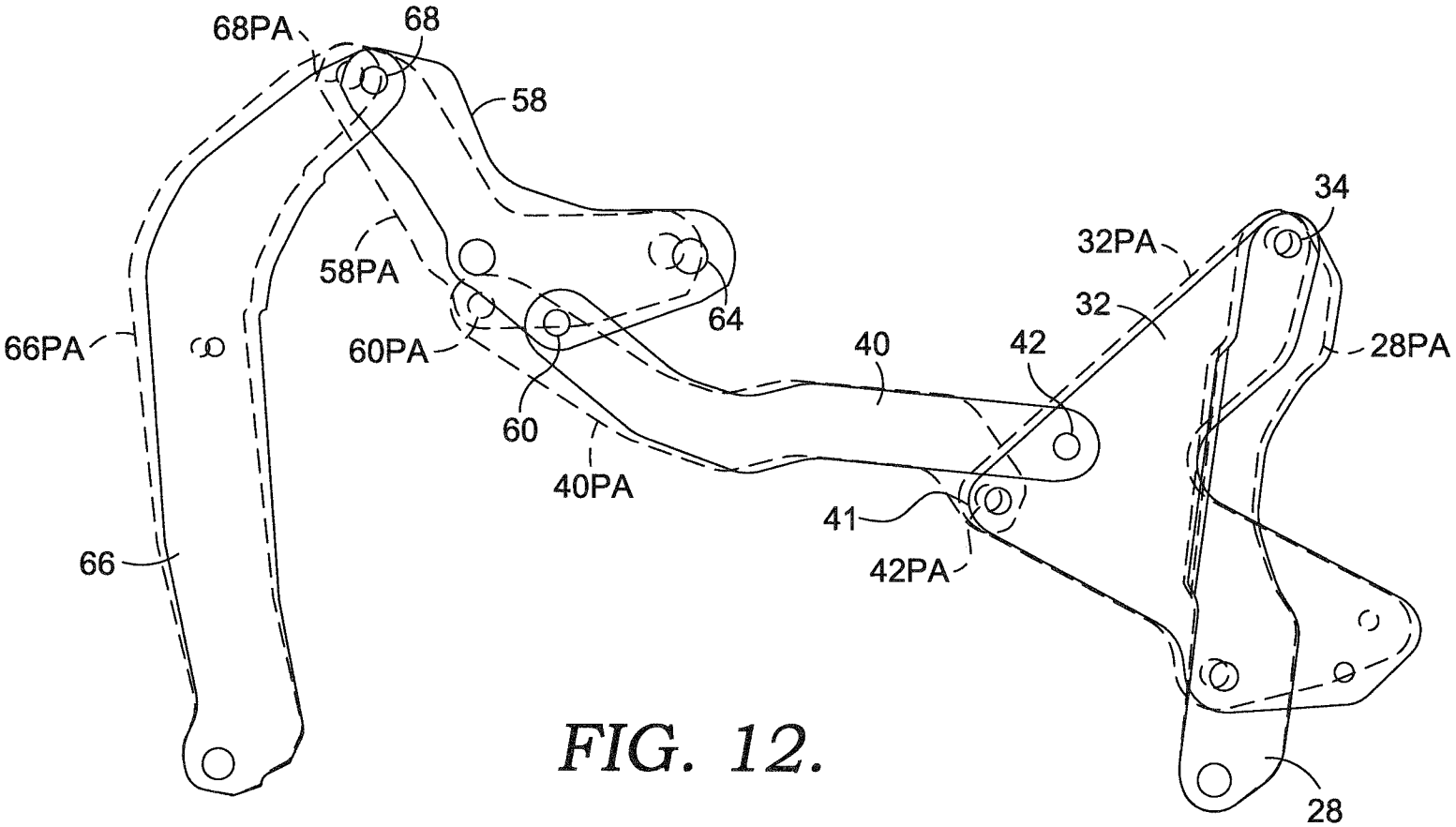
FIG. 12 is a side view of selected links in the closed position, with prior art links in dashed lines for comparison.
Figure 13:
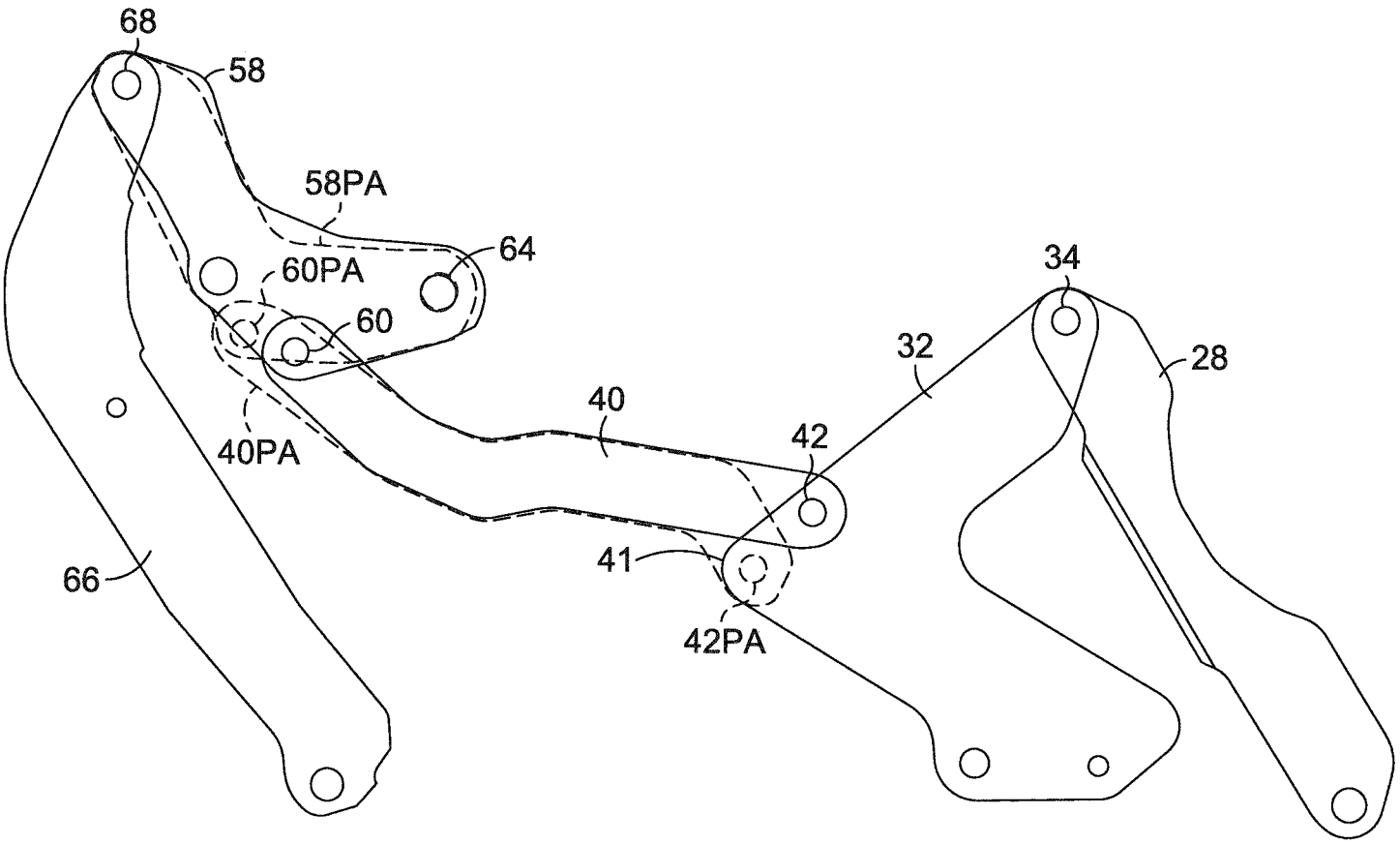
FIG. 13 is a side view of selected links in the TV position, with prior art links in dashed lines for comparison.
Figure 14:
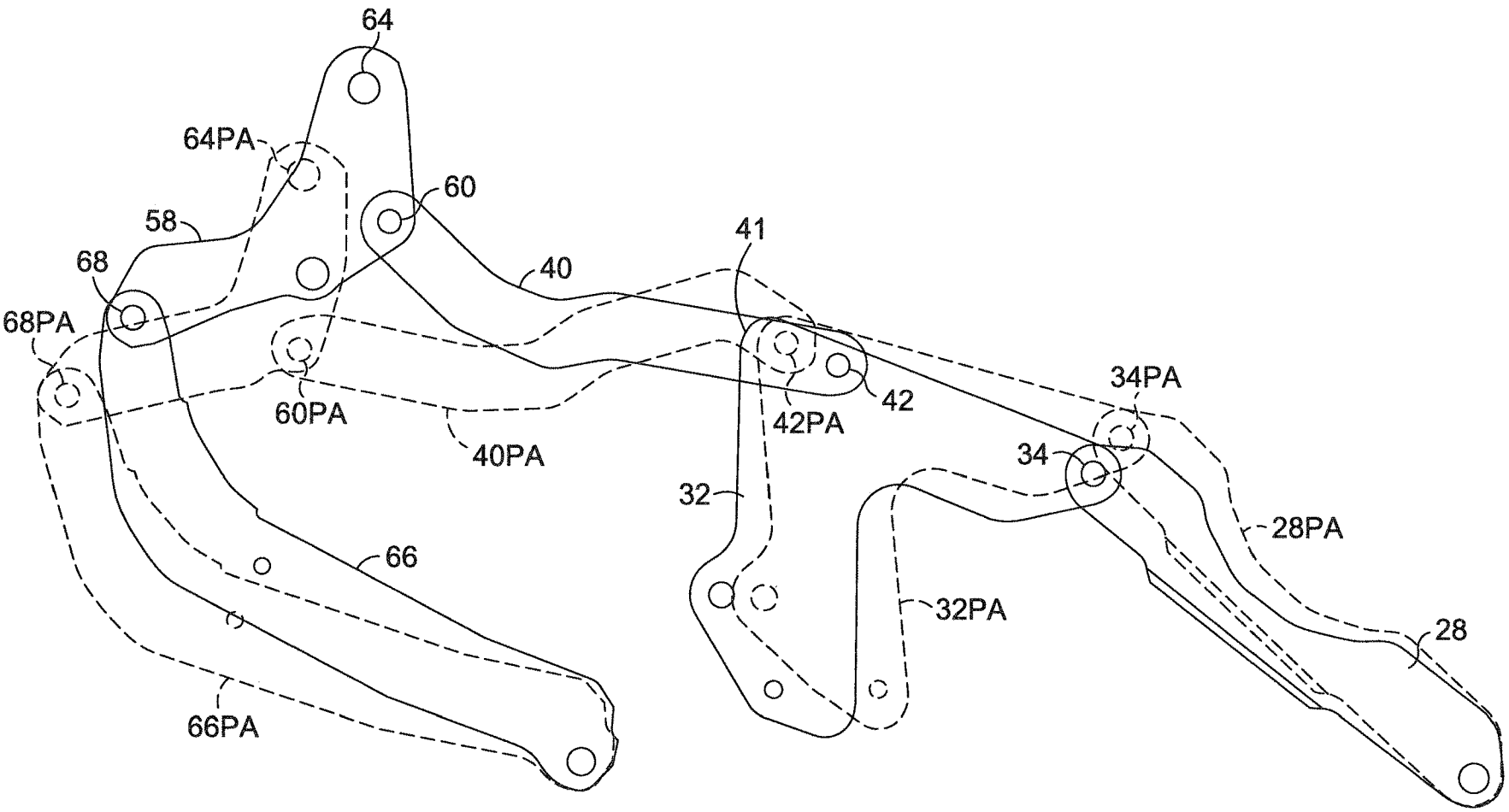
FIG. 14 is a side view of selected links in the fully-reclined position, with prior art links in dashed lines for comparison.

FIGS. 12-14 illustrate an overlay of certain links of linkage mechanism 10 over corresponding links in prior seating units (labeled with corresponding numerals followed by PA). FIG. 12 shows the links and corresponding pivots in the closed position. FIG. 13 shows the links and corresponding pivots in the TV position. FIG. 14 shows the links and corresponding pivots in the fully-reclined position. More specifically, FIGS. 12-14 show the rear pivot link 28, rear lift link 32, connector link 40, front lift link 58 and front pivot link 66 in the closed, TV and fully-reclined positions. In the closed position, the links and pivots largely match, except for pivot 42 coupling rear lift link 32 to connector link 40, and pivot 60 coupling connector link 40 with front lift link 58. As can be seen by comparing rear lift link 32, pivot 42 and connector link 40 with rear lift link 32PA, pivot 42PA and connector link 40PA, the pivot 42 is located behind and above (in the closed position of FIG. 12) where pivot 42PA was. Additionally, pivot 60 coupling connector link 40 with front lift link 58 is located behind and slightly below (in the closed position of FIG. 12) where pivot 60PA was. By moving pivot 42 and pivot 60 (and changing connector link 40 and front lift link 58 slightly), the linkage mechanism 10 moves the seating unit 12 from a similar closed position, to a similar TV position, to a similar recline position, as can be achieved with previous mechanisms. However, by moving pivot 42 and pivot 60 (and changing connector link 40 and front lift link 58 slightly), linkage mechanism 10 can be operated to achieve a new fully-reclined position (as seen in FIG. 10) with the ottoman bracket assembly 100 further elevated from the support surface, and with the seat mounting plate 48 (and more specifically the plane formed by front seat mounting tab 49 and rear seating mounting tab 51, and thus seat 14) further inclined from back to front, allowing users an additional position which may be comfortable and desired in certain situations. This new fully-reclined position can be adjusted by moving pivot 42 and pivot 60 (and making corresponding changes to rear lift link 32, connector link 40 and front lift link 58) to position the plane formed by front seat mounting tab 49 and rear seat mounting tab 51 between a range of angles. In some aspects, this range of angles is between eighteen and twenty-six degrees. In a preferred aspect, the angle is about twenty-four degrees.

The present invention has been described in relation to particular embodiments, which are intended in all respects to be illustrative rather than restrictive. Alternative aspects will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A metal-to-the-floor linkage mechanism providing backrest recline and ottoman extension for a seating unit, the linkage mechanism comprising:

a base;

a pair of spaced, opposed seat mounting plates, spaced apart from the base, the pair of seat mounting plates attachable to a seat of the seating unit; and a first plurality of links and a second plurality of links, each of said first plurality of links and said second plurality of links being pivotally coupled between the base and a corresponding one of the pair of seat mounting plates, to moveably interconnect the base and the seat mounting plates to control movement of the seating unit between closed, TV, reclined and fully-reclined positions;

wherein, in the fully-reclined position, the seat mounting plates are moved to a position by said first plurality of links and said second plurality of links to place the seat of the seating unit at an angle relative to horizontal of between eighteen and twenty-six degrees.

2. The linkage mechanism of claim 1, further comprising:

a drive tube spanning the space between the seat mounting plates and coupled to one of the plurality of links in each of said first plurality of links and said second plurality of links; and a motor coupled on a first end to the base, and pivotally coupled on a second end to the drive tube;

wherein, from the closed position, actuation of the motor causes forward movement of the drive tube, and wherein forward movement of the drive tube causes movement of the seating unit from a closed position to a TV position, and further actuation of the motor results in movement from the TV position to the reclined position, and further actuation of the motor results in movement from the reclined position to the fully-reclined position.

3. The linkage mechanism of claim 2, further comprising a pair of drive tube mounting brackets rigidly secured between each drive tube opposed end, and a respective one of the plurality of links of each of said first plurality of links and said second plurality of links.

4. The linkage mechanism of claim 3, wherein the base includes a pair of spaced apart side rails, one of each said side rails corresponding to one of the first plurality of links and the second plurality of links, and wherein each of the first plurality of links and the second plurality of links comprises:

a rear pivot link having a first end pivotally coupled to the corresponding side rail and having a second end distal from the first end;

a front pivot link having a first end pivotally coupled to the corresponding side rail and spaced from the pivotal connection of the first end of the rear pivot link and the corresponding side rail, and having a second end distal from the first end;

a rear lift link pivotally coupled at a first point to the second end of the rear pivot link, and pivotally coupled at a second point to a corresponding one of the seat mounting plates;

a front lift link pivotally coupled at a first point to the second end of the front pivot link, and pivotally coupled at a second point to a corresponding one of the seat mounting plates; and a connector link pivotally coupled between the rear lift link and the front lift link.

5. The linkage mechanism of claim 4, wherein the motor is pivotally coupled to the midpoint of the drive tube.

6. The linkage mechanism of claim 5, wherein the front pivot link, the rear pivot link, the rear lift link, the front lift link and the connector link elevate the pivotal connection of the front lift link and the seat mounting plate above a support surface a greater distance than the pivotal connection of the rear lift link and the seat mounting plate above the support surface when in the fully-reclined position to place the seat of the seating unit at an angle relative to horizontal of between eighteen and twenty-six degrees.

7. The linkage mechanism of claim 6, further comprising an ottoman-extension linkage pivotally coupled to the seat mounting plate, the ottoman extension linkage extending an ottoman of the seating unit as the linkage mechanism moves from the closed to the TV position, and wherein, in the fully-reclined position, the ottoman extension linkage is moved to elevate the ottoman between four and seven inches further above the support surface relative to the position of the ottoman in the reclined position.

8. A seating unit comprising:

a seat;

an ottoman;

a back;

a base;

a metal-to-the-floor linkage mechanism that couples together the seat, the ottoman and the backrest of the seating unit, the linkage mechanism comprising:

a pair of spaced, opposed seat mounting plates coupled to the seat; and a first plurality of links and a second plurality of links, each of said first plurality of links and said second plurality of links being pivotally coupled between the base and a corresponding one of the pair of seat mounting plates, to moveably interconnect the base and the seat mounting plates to control movement of the seating unit between closed, TV, reclined and fully-reclined positions;

wherein, in the fully-reclined position, the seat is moved to a position by said pair of seat mounting plates and said first plurality of links and said second plurality of links to place the seat of the seating unit at an angle relative to horizontal of between eighteen and twenty-six degrees.

9. The seating unit of claim 8, further comprising:

a drive tube spanning the space between the seat mounting plates and coupled to one of the plurality of links in each of said first plurality of links and said second plurality of links; and a motor coupled on a first end to the base, and pivotally coupled on a second end to the drive tube;

wherein, from the closed position, actuation of the motor causes forward movement of the drive tube, and wherein forward movement of the drive tube causes movement of the seating unit from a closed position to a TV position, and further actuation of the motor results in movement from the TV position to the reclined position, and further actuation of the motor results in movement from the reclined position to the fully-reclined position.

10. The seating unit of claim 9, further comprising a pair of drive tube mounting brackets rigidly secured between each drive tube opposed end, and a respective one of the plurality of links of each of said first plurality of links and said second plurality of links.

11. The seating unit of claim 10, wherein the base includes a pair of spaced apart side rails, one of each said side rails corresponding to one of the first plurality of links and the second plurality of links, and wherein each of the first plurality of links and the second plurality of links comprises:

a rear pivot link having a first end pivotally coupled to the corresponding side rail and having a second end distal from the first end;

a front pivot link having a first end pivotally coupled to the corresponding side rail and spaced from the pivotal connection of the first end of the rear pivot link and the corresponding side rail, and having a second end distal from the first end;

a rear lift link pivotally coupled at a first point to the second end of the rear pivot link, and pivotally coupled at a second point to a corresponding one of the seat mounting plates;

a front lift link pivotally coupled at a first point to the second end of the front pivot link, and pivotally coupled at a second point to a corresponding one of the seat mounting plates;

a connector link pivotally coupled between the rear lift link and the front lift link.

12. The seating unit mechanism of claim 11, wherein the motor is pivotally coupled to the midpoint of the drive tube.

13. The seating unit of claim 12, wherein the front pivot link, the rear pivot link, the rear lift link, the front lift link and the connector link elevate the pivotal connection of the front lift link and the seat mounting plate above a support surface a greater distance than the pivotal connection of the rear lift link and the seat mounting plate above the support surface when in the fully-reclined position to place the seat of the seating unit at an angle relative to horizontal of between eighteen and twenty-six degrees.

14. The seating unit of claim 13, further comprising an ottoman-extension linkage pivotally coupled to the seat mounting plate, the ottoman extension linkage extending the ottoman as the linkage mechanism moves from the closed to the TV position, and wherein, in the fully-reclined position, the ottoman extension linkage is moved to elevate the ottoman between four and seven inches further above a support surface relative to the position of the ottoman in the reclined position.

15. A metal-to-the-floor linkage mechanism providing powered movement of a seating unit from a closed, to a TV, to a reclined and to a fully-reclined position, the linkage mechanism comprising:

a base;

a pair of spaced, opposed seat mounting plates, spaced apart from the base, the pair of seat mounting plates including at least a pair of seat mounting tabs, the seat mounting tabs forming an attachment plane for a seat of the seating unit; and a first plurality of links and a second plurality of links, each of said first plurality of links and said second plurality of links being pivotally coupled between the base and a corresponding one of the pair of seat mounting plates, to moveably interconnect the base and the seat mounting plates to control movement of the seating unit between closed, TV, reclined and fully-reclined positions;

wherein, in the fully-reclined position, the seat mounting plates are moved to a position by said first plurality of links and said second plurality of links to place the plane of the seat mounting tabs at an angle relative to horizontal of between eighteen and twenty-six degrees.

* * * * *